US005131898A

United States Patent [19]

Panagos

[11] Patent Number: 5,131,898

[45] Date of Patent: Jul. 21, 1992

[54] INTERLOCKING DUMBBELLS

[76] Inventor: George C. Panagos, #12063, Gainesville, Fla. 32604

[21] Appl. No.: 591,404

[22] Filed: Oct. 1, 1990

[51] Int. Cl.[5] ..... A63B 21/072

[52] U.S. Cl. ..... 482/108; 482/106

[58] Field of Search ..... 272/122, 123

[56] References Cited

U.S. PATENT DOCUMENTS

| | | | |
|---|---|---|---|
| 4,531,728 | 7/1985 | Wright | 272/122 |
| 4,566,690 | 1/1986 | Schook | 272/123 |
| 4,830,361 | 5/1989 | Hoffman | 272/122 X |
| 4,913,422 | 4/1990 | Elmore et al. | 272/123 |

FOREIGN PATENT DOCUMENTS

| | | | |
|---|---|---|---|
| 1367987 | 1/1988 | U.S.S.R. | 272/122 |

*Primary Examiner*—Richard J. Apley
*Assistant Examiner*—D. F. Crosby

[57] ABSTRACT

An exercise device which is designed for connecting it to identical exercise devices. The exercise device is a dumbbell with a pair of solid single dumbbell weights securely mounted on each end of an axially extending short handle. There are three male connectors and three female connectors positioned for connecting the dumbbell to another dumbbell either horizontally or vertically. The connection of two exercise devices is maintained by holding the exercise devices together with two hands while gripping the short handles of the exercise devices. Included is a corresponding weight training method.

2 Claims, 3 Drawing Sheets

INTERLOCKING DUMBBELLS

CROSS REFERENCES TO RELATED APPLICATIONS

| | |
|---|---|
| Ser. No. 417,854 | October 6, 1989 |
| Ser. No. 07/608,725 | November 5, 1990 |

BACKGROUND OF THE INVENTION

1. Field of the Invention

This application relates to dumbbell and barbell weight training and exercise equipment and more particularly to solid dumbbells with interlocking connectors as well as corresponding weight training methods which allow a weightlifter to use solid dumbbells while they are connected.

2. Description of the Related Art

U.S. Pat. No. 4,566,690 to Schook, U.S. Pat. No. 4,913,422 to Elmore et al., U.S. Pat. No. 4,830,361 to Hoffman, U.S. Pat. No. 4,531,728 to Wright, and S.U. Patent No. 1367,987. A to Zver all describe how to combine and connect various exercise devices. However, the main focus of the references cited, is in describing the use of add-on weights. Although add-on weights such as weight plates and discs, etc. and their adaptation to barbells and dumbbells have long ben a part of the weightlifting and exercise equipment inventory, their use has never gone to the extent of either excluding or replacing the solid dumbbell as the equipment of choice by weightlifters in general for a variety of weightlifting exercise. The prior art does not formally address the need for connecting and combining solid dumbbells together.

SUMMARY OF THE INVENTION

Therefore, in order to meet this need, the present invention is a dumbbell comprising a pair of solid single dumbbell weighs mounted ne each end of an axially extending short handle. The dumbbell has three male connectors and three female connectors for connecting two identical dumbbells together either horizontally or vertically. The connection of two identical dumbbells is engaged and maintained by holding the connected dumbbells together with two hands while gripping the short handles of the dumbbells. Included is a corresponding weight training method wherein a weightlifter, using two hands grasps two dumbbells, one in each hand and holds the dumbbells together in connected fashion and successively lifts the dumbbells maintaining them in connected fashion. The purpose of this invention is to enable a weightlifter to do barbell exercises and dumbbell exercises while using the same exercise device.

DESCRIPTION OF THE PREFERRED EMBODIMENT

Figure 1:
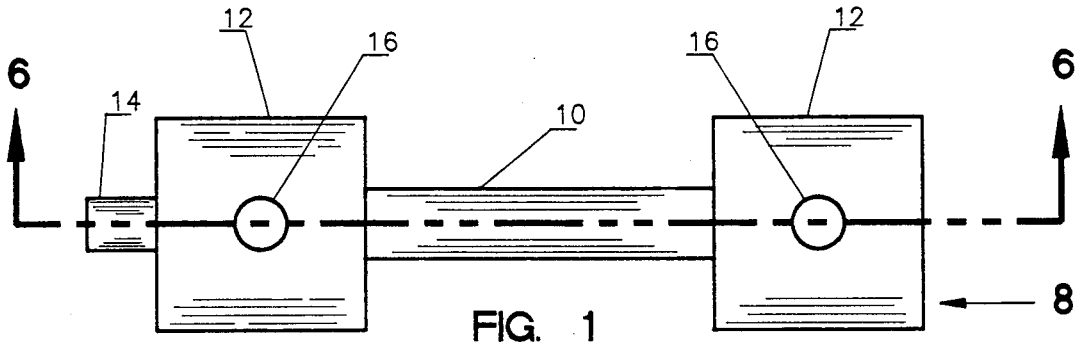
FIG. 1 is a top view showing the weighted ends and the short handle of an interlocking dumbbell. Also depicted are two radially projecting male connectors and the one axially projecting male connector.
Figure 6:
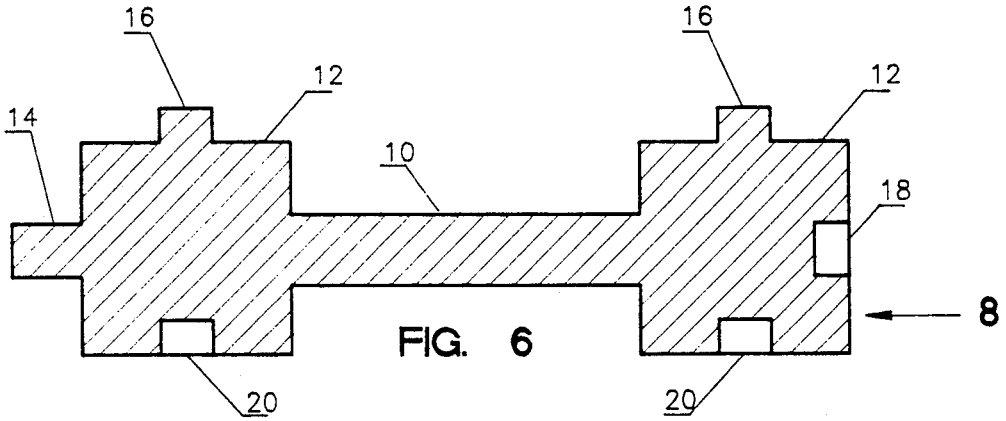
FIG. 6 is a cross sectional view of an interlocking dumbbell showing the two weighted ends and short handle, two radially projecting male connectors, and one axially projecting male connector. Also depicted are two radially recessed female connectors and one axially recessed female connector.
Figure 4:
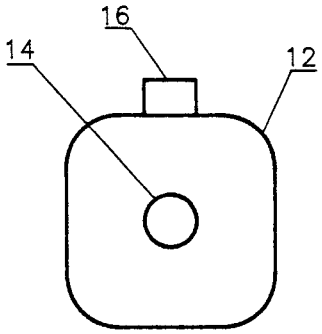
FIG. 4 is a side or end view showing a projecting male connector.
Figure 5:
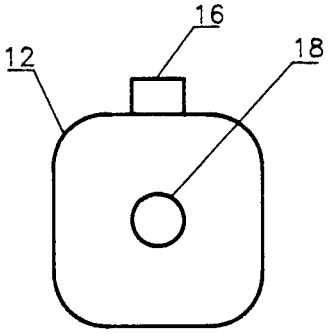
FIG. 5 is a side or end view showing a recessed female connector.
Figure 2:
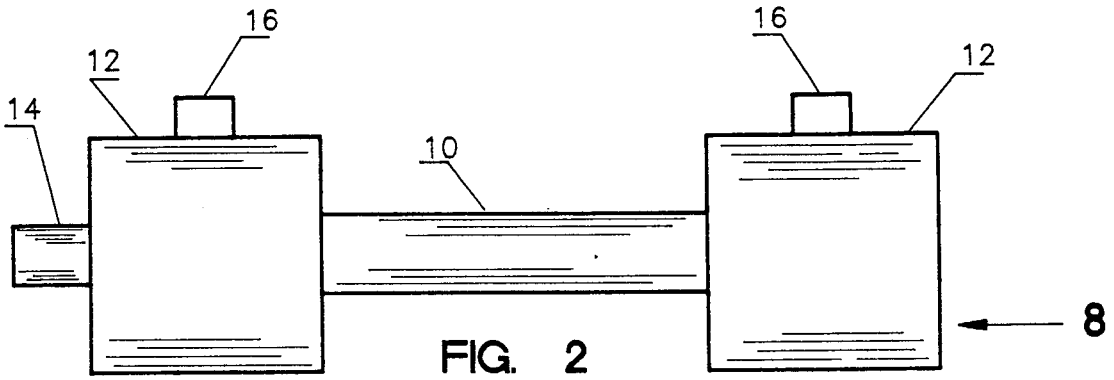
FIG. 2 is a front view showing the weighted ends and the short handle of an interlocking dumbbell. Also depicted are two radially projecting male connectors and one axially projecting male connector.
Figure 3:
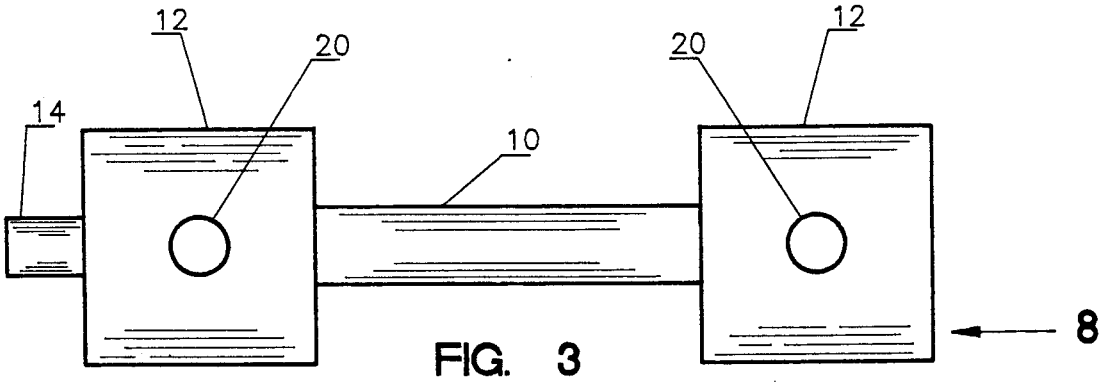
FIG. 3 is a bottom view showing the weighted ends and the short handle of an interlocking dumbbell. Also depicted are two recessed female connectors and one axially projecting male connector.
Figure 7:
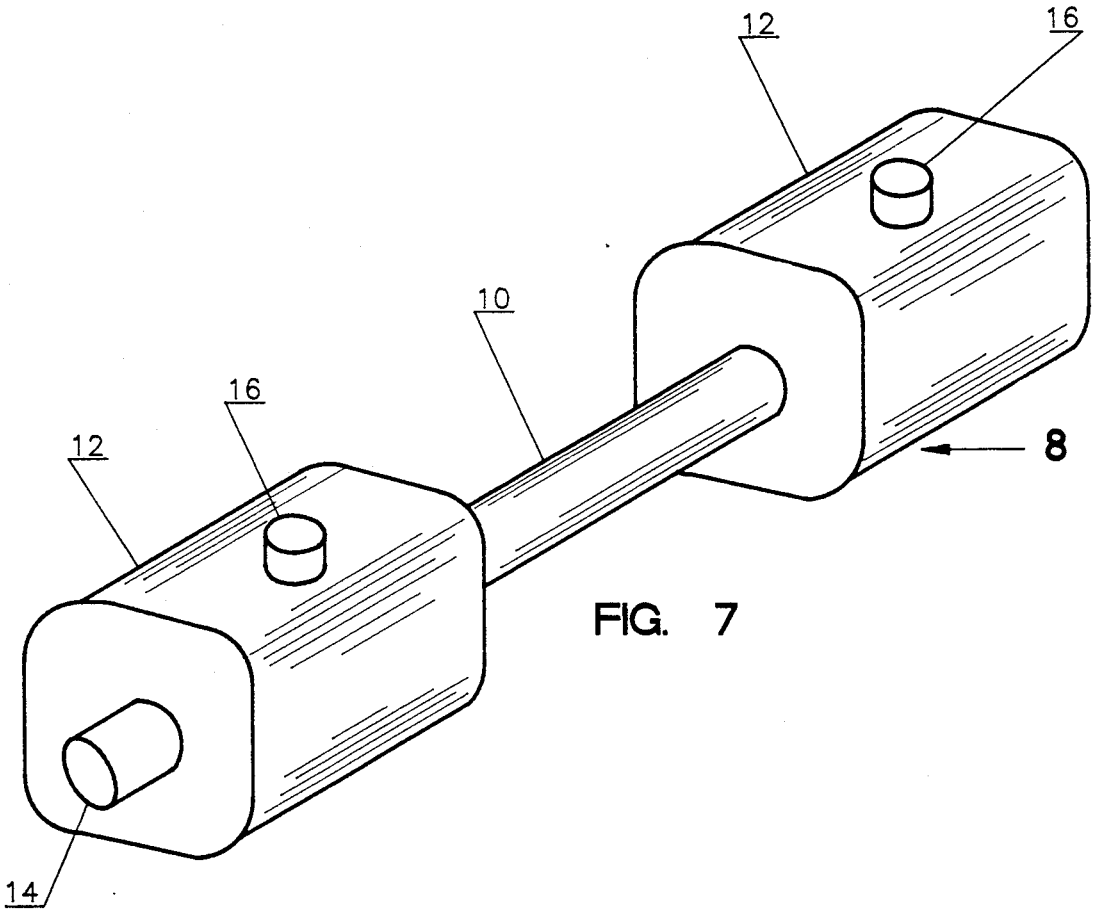
FIG. 7 is a three-dimensional representation of an interlocking dumbbell showing the weighted ends and short handle, two radially projecting male connectors, and one axially projecting male connector.

An interlocking dumbbell exercise device 8 is depicted in FIGS. 1–3 and 6, 7. The interlocking dumbbell 8 includes an axially extending short handle 10, along with a pair of solid dumbbell weights 12 mounted securely on each end of handle 10. Attached to and part of the exercise device 8 are three small cylindrical male connectors 14 and 16 and three small cylindrical female connectors 18 and 20, all of which can be made from cast iron or other suitable materials.

The solid single dumbbell weights 12 may be permanently affixed to each end of short handle 10 and the small cylindrical male connectors 14 and 16 may be permanently affixed to the solid single dumbbell weights 12. For this purpose, the male connectors 14 and 16 and the dumbbell weights 12 may be welded or molded in place. The small cylindrical female connectors 18 and 20 may be permanently recessed into the dumbbell weights 12 by drilling or boring. Alternately, the entire exercise device 8 may be produced by using a casting procedure.

Attention is next directed to the positions of the small cylindrical male connectors 14 and 16 and the small cylindrical female connectors 18 and 20 attached to and part of the slid dumbbell weights 12. One male connector 16 is centrally located on and projecting radially from an outer surface of each weight 12, and a third male connector 14 is centrally located on and projecting axially from an outer end of one of the weights 12. One female connector 20 is extending radially and centrally recessed into an outer surface of each weight 12, and a third female connector 18 is extending axially and centrally recessed into an outer end of the other weight 12.

A weightlifter can now connect two identical exercise devices 8 together, either horizontally or vertically. The connection is engaged and maintained by holding the connected exercise devices 8 together with two hands while gripping the short handles 10 of the exercise device 8 and inserting or positioning the respective male connectors 14 and 16 into the corresponding female connectors 18 and 20.

When, a weight training method, wherein a weightlifter using two hands, grasps two exercise devices 8, one in each hand, and holds the devices 8 together in connected fashion, and successively lifts the devices 8 maintaining them in connected fashion, and alternately when two exercise devices 8 are lifted successively in a unconnected fashion is practices by a weightlifter, he or she will receive the benefit of better performance while doing a variety of barbell and dumbbell exercises using the same interlocking dumbbell exercise device.

I claim:

1. An exercise device comprising a means for connecting it to identical exercise devices wherein:

said exercise device is a dumbbell comprising a pair of solid single dumbbell weights mounted on each end of an axially extending short handle, said weights having a predetermined weight, said connected means comprising at least three small cylindrical male connectors and three small cylindrical female connectors, attached to and part of said dumbbell weights, said connectors comprising one male connector being centrally located on and projecting radially from an outer surface of each weight, and another male connector being centrally located on and projecting axially from an outer end of one of said weights, one female connector extending radially and centrally recessed into an outer surface of each weight and another female connector extending axially and centrally recessed into an outer end of the other of said weights, for connecting two identical exercise devices together either horizontally or vertically, said connection being engaged and maintained by holding said connected exercise devices together with two hands while gripping the short handles of the exercise devices.

2. A weight training method wherein a weightlifter, using two hands, grasps two exercise devices of claim 1, one in each hand, and holds said devices together in connected fashion, and successively lifts the devices maintaining them in connected fashion.

* * * * *